United States Patent [19]

Currie

[11] Patent Number: 4,935,893

[45] Date of Patent: Jun. 19, 1990

[54] DATA DISPLAY APPARATUS

[75] Inventor: Stephen R. Currie, Camberley, Great Britain

[73] Assignee: International Computers Limited, London, England

[21] Appl. No.: 398,305

[22] Filed: Aug. 25, 1989

Related U.S. Application Data

[63] Continuation of Ser. No. 33,807, Apr. 3, 1987, abandoned.

[30] Foreign Application Priority Data

May 30, 1986 [GB] United Kingdom ..... 8613153

[51] Int. Cl.[5] ..... B06F 3/153

[52] U.S. Cl. ..... 364/900; 364/927.4; 364/926.92; 364/967.1; 340/723

[58] Field of Search ... 364/200 MS File, 900 MS File; 340/721, 720, 723

[56] References Cited

U.S. PATENT DOCUMENTS

| | | | |
|---|---|---|---|
| 4,150,429 | 4/1979 | Ying | 364/200 |
| 4,161,777 | 7/1979 | Ying | 364/200 |
| 4,258,361 | 3/1981 | Hydes et al. | 340/721 |
| 4,338,599 | 7/1982 | Leininger | 340/721 |
| 4,441,105 | 4/1984 | Van Vliet et al. | 340/750 |
| 4,470,042 | 9/1984 | Barnich et al. | 340/721 |
| 4,484,187 | 11/1984 | Brown et al. | 340/703 |
| 4,495,594 | 1/1985 | Eggebrecht et al. | 364/900 |
| 4,503,429 | 3/1985 | Schreiber | 340/799 |
| 4,694,392 | 9/1987 | Ballard et al. | 364/200 |
| 4,720,708 | 1/1988 | Takeda et al. | 340/814 |

*Primary Examiner*—Thomas M. Heckler
*Attorney, Agent, or Firm*—Lee, Mann, Smith, McWilliams & Sweeney

[57] ABSTRACT

Data display apparatus is described in which data from a video RAM is displayed on a CRT monitor. The apparatus includes master and slave CRT controllers which are locked together in synchronism. In operation, the displayed is divided into a main application area and a noticeboard area. The master controller is selected for display of the main application area, and the slave controller is selected for display or the noticeboard area. This allows the two areas to be displayed with different parameters, e.g. number or characters per line, without the necessity for re-programming the CRT controllers part way through the frame.

7 Claims, 2 Drawing Sheets

DATA DISPLAY APPARATUS

This application is a continuation, of application Ser. No. 33,807, filed Apr. 3, 1987 now abandoned.

This invention relates to data display apparatus. The invention is particularly, although not exclusively, concerned with apparatus for displaying the data output of a computer, either text or graphics, on a raster-scanned display, for example a cathode ray tube (CRT).

CRT controllers are commercially available for providing an interface between a computer and a CRT. Such controllers are designed to produce sequences of addresses for a video memory, and to generate horizontal and vertical synchronization signals for the CRT with appropriate timing. Such a controller must be programmed so that it can generate the appropriate sequence of addresses according to the parameters of the data to be displayed. For example, in order to display text, the controller must know the number of characters in each line of the display, the number of raster scan lines in each character, and so on.

In certain applications, it is desirable to divide a data display into two or more separate areas. For example, a small area at the bottom of the display screen may be used as a noticeboard for displaying control messages from the computer, while the rest of the screen, referred to as the application area, is used for the main task. In this case, it is desirable to be able to display data in the application area in any one of a number of different modes e.g. high-resolution graphics, 40 characters-per-line text, 80 characters-per-line text, and son on, while displaying the noticeboard in a single mode only e.g. 80 characters-per-line text.

This presents a problem, since in order to convert from, say, 40 character to 80 character modes, it is necessary to reprogram the controller part way through a frame, and there is not enough time available to do this in the horizontal retrace time of a CRT (which may be about 7 microseconds).

The object of the invention is to overcome this problem.

SUMMARY OF THE INVENTION

According to the invention there is provided data display apparatus comprising (a) raster-scanning display means for producing a display comprising a plurality of raster lines, (b) a video memory having a data output coupled to the display means, and having an address input, (c) first controller means having an address output, for producing a first sequence of addresses, (d) second controller means having an address output, for producing a second sequence of addresses, and (e) selection means for coupling the address output of the first controller means to the address input of the video memory, and then, at a preselectable raster line of the display, decoupling the address output of the first controller means and in its place coupling the address output of the second controller means to the address input of the video memory.

Thus, it can be seen that, for example, the first controller can be used for addressing the video memory to display an application area, while the second controller can be used to address the video memory to display a noticeboard. Each controller can be programmed differently, so that it is possible to display the application area and the noticeboard in different display modes without having to reprogram either of them during the display.

BRIEF DESCRIPTION OF THE DRAWINGS

One data display apparatus in accordance with the invention will now be described by way of example with reference to the accompanying drawings.

DESCRIPTION OF AN EMBODIMENT OF THE INVENTION

Figure 1:
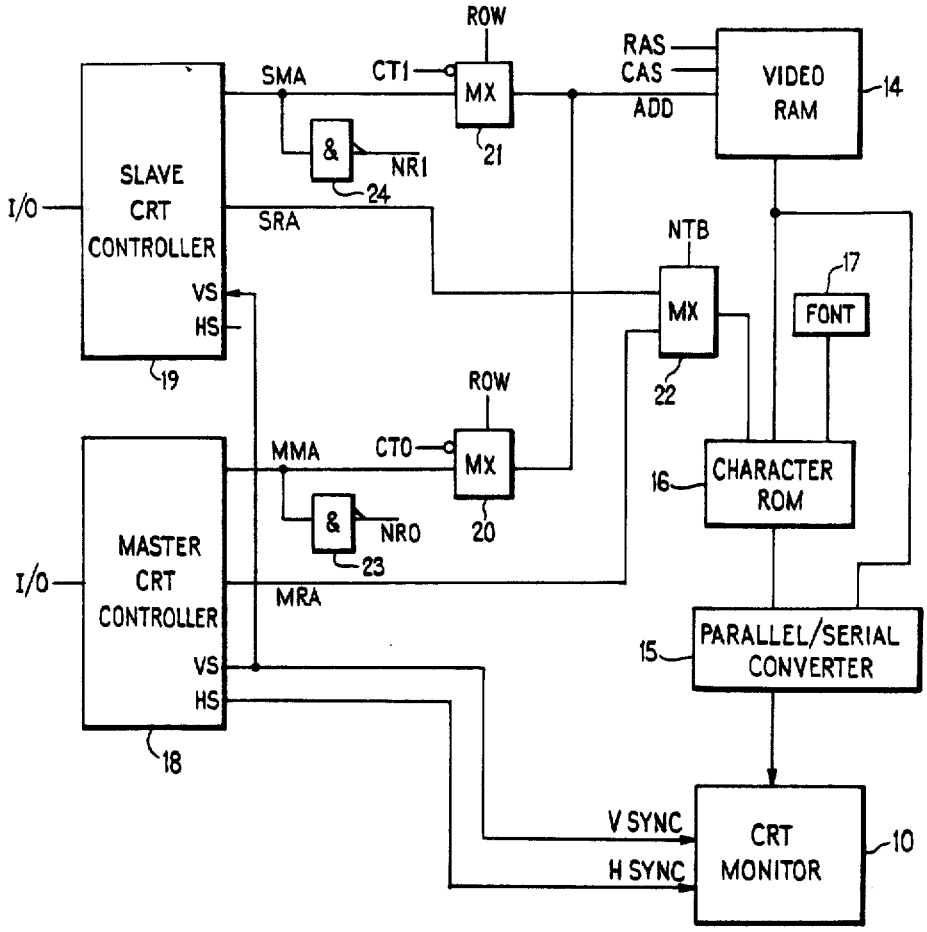
FIG. 1 is a block diagram of the apparatus.

Referring to FIG. 1, the apparatus comprises a CRT monitor 10 of conventional form, having inputs for receiving horizontal and vertical synchronization signals HSYNC, VSYNC for synchronizing the raster-scanned display.

The system also includes a video random-access memory (RAM) 14 for holding the data to be displayed on the monitor 10. In a graphics mode, this data represents intensity and/or colour values for the individual pixels (picture elements) of the display. In a text mode, this data consists of character codes, identifying the characters to be displayed. The contents of the video RAM 14 can be read and updated in a conventional manner by a computer (not shown) which generates the data to be displayed.

In the graphics mode, the pixel data from the video RAM is applied directly to a parallel-to-serial converter 15, producing video signals for the monitor 10. In the text mode, the pixel data is produced by a character read-only memory (ROM) 16, which stores the pattern of pixels forming each individual character to be displayed. The character ROM is addressed by the combination of three signals: the character code read out of the video RAM 14; a font code from a FONT register 17, specifying one of a number of different character fonts; and a raster address signal RA which identifies which raster line of the line of characters is currently being scanned.

The video RAM 14 is a conventional row/column organised memory, having row and column address registers (not shown). The row address register is loaded from an address input path ADD by a row address signal RAS, while the column address register is loaded from the same address input path by a column address strobe signal CAS. The contents of the row and column address registers together select a particular word in the RAM for reading or writing.

The display apparatus also includes two CRT controllers referred to as the master controller 18 and the slave controller 19. In this example, each of these controllers is a Fujitsu MB 89321 controller, which is a single-chip CMOS device.

Each controller has a memory address output (MMA in the case of the master, SMA in the case of the slave) which provides the address for the video RAM 14. Each controller also has a raster address output MRA, SRA which provides the raster address for the character ROM 16 in test display mode.

The controller chip has a number of internal registers (not shown) which may be programmed by means of an input/output port I/O to set up the controller for a particular mode of operation. For example, these internal registers specify the number of characters in each line, the horizontal display period, the number of raster lines in each line of characters, and the total number of raster lines in the display. The settings of these registers control the sequencing of the addresses MMA/SMA and MRA/SRA so as to read out the data from the video RAM 14 and character ROM 16 in the correct sequence for the chosen display mode. The controller chip also provides the facility for dividing the display screen up into up to four horizontal bands. The first of these bands always starts at scan line 0 (i.e. the top of the screen). The starting positions of the other three bands are defined by the contents of three display start position registers in the controller chip. The display data for each of the four bands can be held at any address within the video RAM, the start address for the data in each band being defined by the contents of four start address registers in the controller chip.

For further details of the controller chip, reference can be made to the manufacturer's technical specification.

Referring still to FIG. 1, the memory address output MMA of the master controller 18 is applied to a multiplexer 20, the output of which is connected to the address input ADD of the video RAM 14. The multiplexer 20 is controlled by a signal ROW which alternately selects row and column address fields from the memory address MMA, in synchronization with the RAS and CAS strobe signals. The multiplexer 20 is enabled when a control signal CT0 is false.

Similarly, the address output SMA of the slave controller is fed to the address input ADD of the video RAM by way of a multiplexer 21. This multiplexer is enabled when a control signal CT1 is false.

The raster addresses MRA and SRA from the master and slave controllers are connected to the inputs of a multiplexer 22, controlled by a signal NTB. When NTB is false, the multiplexer 22 selects MRA, and when NTB is true it selects SRA. The output of the multiplexer 22 supplies the raster address signal RA for the character ROM 16.

Each of the controllers 18,19 has horizontal and vertical synchronization terminals Hs and Vs. The synchronization terminals of the master controller provide the horizontal and vertical synchronization signals HSYNC, VSYNC for the CRT monitor 10. The vertical synchronization terminal VS of the master controller is also connected to the VS terminal of the slave controller, which in this case is programmed to act as a synchronization input so as to lock the two controllers together in timing.

The memory address MMA from the master controller is also fed to a NAND gate 23, to produce a control signal NR0. It can be seen that this signal NR0 goes false when an all-ones address MMA is detected. Similarly, the memory address SMA from the slave controller is fed to a NAND gate 24, producing a control signal NR1 which goes false when SMA is all-ones.

Figure 2:
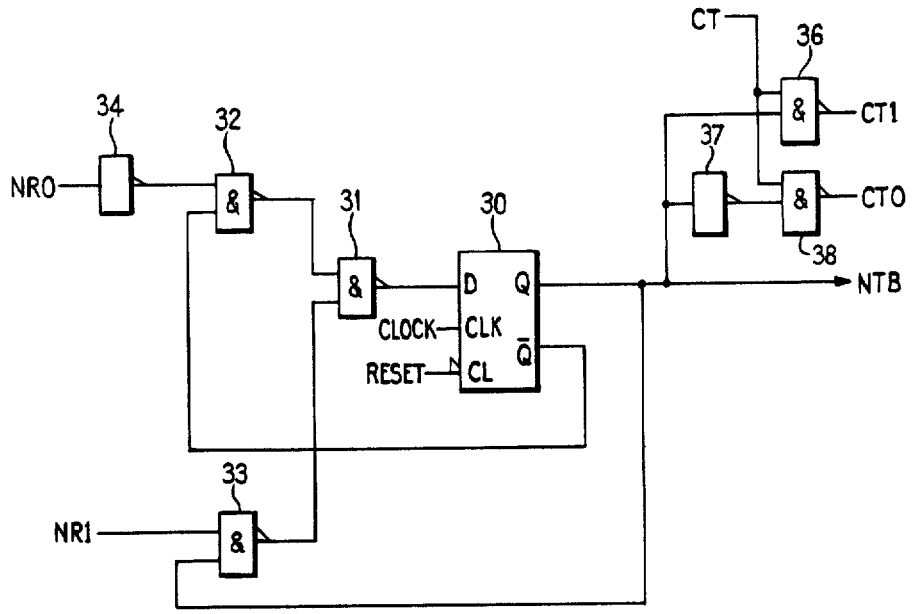
FIG. 2 is a circuit diagram showing a part of the apparatus which selects one or other of two controllers.

Referring now to FIG. 2, this shows a control circuit for producing the control signals CT0, CT1 and NTB referred to above.

The control circuit includes a bistable circuit (flip-flop) 30 having outputs Q and Q, and a data input D.

The data input D is connected to the output of a NAND gate 31, the inputs of which are connected to two further NAND gates 32,33. One input of the NAND gate 32 receives the signal NR0 by way of an inverter 34 while the other input receives the Q output of the bistable. One input of NAND gate 33 receives the signal NR1, while the other input receives the Q output.

Thus, it can be seen that when NR0 goes false, the bistable 30 is set into its Q state, and is latched in that state by the feedback connection through NAND gate 32. When NR1 goes false, the bistable is set into its Q state, and is latched in that state by NAND gate 33.

The bistable 30 can also be reset to its Q state by a RESET signal, which is produced at each vertical synchronization signal VSYNC i.e. at the start of each frame of the display.

The Q output of the bistable provides the signal NTB. It is also applied to a NAND gate 36, which produces the signal CT1, and is applied by way of an inverter 37 to a NAND gate 38 which produces the signal CT0. The NAND gates 36,38 are both controlled by a signal CT which indicated that the CRT controllers are permitted to access the video RAM.

Thus, it can be seen that when the bistable 30 is latched in its Q state, NTB is false, CT0 false, and CT1 true. Hence, in this state the multiplexer 20 is enabled so as to apply the address MMA to the video RAM, and the multiplexer 22 is switched so as to apply the address MRA to the character ROM. The master controller is therefore selected. Conversely, when the bistable 30 is latched in its Q state, NTB is true, CT0 true, and CT1 false. Hence, in this state the multiplexer 21 is enabled so as to apply the address SMA to the video RAM, and the multiplexer 22 is switched so as to apply the address SRA to the character ROM. The slave controller is therefore selected.

Operation

One possible way of operating the apparatus described above will now be described by way of example.

In this example, the apparatus is operated to display two areas on the screen of the CRT monitor: a main application area, containing data relating to the current task, and a noticeboard area, for displaying messages. The noticeboard area may for example consist of three lines of text at the bottom of the screen, displayed in 80 characters-per-line mode with 8 raster lines for each character line. The application area can be displayed in any one of a number of different modes, e.g. 40 or 80 character text, or graphics.

To achieve this, both the master and slave controllers are programmed with two horizontal display bands, the start position of the second band corresponding to the first raster line of the noticeboard area.

The master controller is programmed so that the start address of its first display band points to the location in the video RAM of the data to be displayed in the main application area. The start address of the second display band is set to a fixed all-ones value i.e. the maximum possible value or MMA. The master controller is also programmed with the desired parameters for the application area i.e. number of characters per line etc.

The slave controller is programmed so that the start address of its second display band points to the location of the noticeboard data in the video RAM. The RAM controller is also programmed with the parameters of the noticeboard area. In this case, the total line width (i.e. number of pixels per line) and the total number of raster lines in the display must be the same as those for the master controller. This is essential since the synchronisation pulses for the monitor come only from the master controller and therefore the slave has to be in step. However, the other parameters, such as number of characters per line, may be different.

At the start of each frame of the display, the vertical synchronization signal VSYNC will reset the bistable 30 to its Q state and hence the master controller is selected. The master controller therefore addresses the video RAM and the character RAM so as to display the data in the main application area.

When the scan reaches the first raster line of the noticeboard area, the master controller will switch to its second display band, and will therefore output as address MMA the all-ones value programmed into it as the start address of the second band. This all-ones value is detected by the NAND gate 23, and therefore the signal NR0 goes fales. This causes the bistable 30 to switch into its Q state, so that the slave controller is now selected. The slave controller now addresses the video RAM and character ROM so as to display the noticeboard data. Finally, at the end of the frame, the bistable 30 is reset to the Q state by the vertical synchronization signal and the above sequence is repeated.

In general, it is also necessary to change the contents of the font register 17 when switching from the application area to the noticeboard. This can easily be done within the horizontal blanking period of the display.

It will be appreciated that the apparatus described above can alternatively be programmed to operate in other ways. For example, it is possible to display two separate application areas, separated by a noticeboard. To achieve this, each controller is programmed with three bands, the start position of the second band being the desired start position of the noticeboard, and the start position of the third band being the desired start of the second application area. The start address of the second band in the master controller is set to all-ones, while the start address of the third band in the slave controller is also set to all-ones.

As before, at the start of each frame, the bistable 30 is reset to the Q state, so as to select the master controller. At the start of the noticeboard, the all-ones value of MMA causes NR0 to go false, and this sets the bistable 30 into the Q state, so that the slave controller is now selected. At the start of the second application area, the all-ones value of SMA causes NR1 to go false, and this resets the bistable 30 into the Q state, selecting the master controller again.

It will be appreciated that the apparatus described above can be modified without departing from the principles of the present invention. For example, the apparatus may have more than one slave controller, allowing three or more different display modes to be produced simultaneously.

I claim:

1. Data display apparatus comprising:
(a) a single raster-scanned display unit for producing a display comprising a plurality of raster lines,
(b) a video memory having a data output coupled to the display unit and having an address input,
(c) first controller means having an address output, for producing a first sequence of addresses,
(d) second controller means having an address output, for producing a second sequence of addresses, and
(e) selection means operable during scanning of a first plurality of raster lines of the display, for coupling the address output of the first controller means to the address input of the video memory, and operable during scanning of a different plurality of raster lines of the display, for coupling the address output of the second controller means to the address input of the video memory.

2. Apparatus according to claim 1 wherein each of the controller means also has a scan line address output for producing a signal indicating which scan line of a row of characters is currently being scanned, and the apparatus also includes
(a) a character memory having an address input and a data output coupled to the display unit, and
(b) further selection means for coupling the scan line address output of the first controller means to the address input of the character memory and then, at a pre-selected raster line, decoupling the scan line address output of the first controller means and in its place coupling the scan line address output of the second controller means to the address input of the character memory.

3. Apparatus according to claim 1 wherein the first controller means also has synchronization outputs for producing synchronization signals, these outputs being connected to the display means.

4. Apparatus according to claim 3 wherein the second controller means has a synchronization input connected to one of the synchronization outputs of the first controller means, thereby locking the first and second controller means together in synchronism.

5. Apparatus according to claim 1 wherein the display means is a cathode-ray tube display device.

6. Data display apparatus comprising:
(a) a single raster scanned display unit for producing a display comprising a plurality of raster lines,
(b) a video memory having a data output coupled to the display unit and having an address input,
(c) first controller means having an address output, for producing a first sequence of addresses,
(d) second controller means having an address output, for producing a second sequence of addresses,
(e) first detection means coupled to the address output of said first controller means, for producing a first control signal upon detection of a predetermined address value from said first controller means,
(f) second detection means coupled to the address output of the second controller means, for producing a second control signal upon detection of a predetermined address value from said second controller means, and
(g) selection means responsive to said second control signal to connect the address output of the first controller means to the address input of the video memory, and responsive to said first control signal to connect the address output of the second controller means to the address input of the video memory.

7. Apparatus according to claim 6 wherein each of the controller means also has a scan line address output for producing a signal indicating which scan line of a row of characters is currently being scanned, and the apparatus includes
(a) a character memory having an address input and a data output coupled to the display means, and
(b) further selection means, responsive to said second control signal to connect the scan line address output of the first controller means to the address input of the character memory, and responsive to said first control signal to connect the scan line address output of the second controller means to the address input of the character memory.

* * * * *